US006886716B2

(12) United States Patent
Weiler

(10) Patent No.: US 6,886,716 B2
(45) Date of Patent: May 3, 2005

(54) CAP WITH UNITARY SECURITY RING

(75) Inventor: Gerhard H. Weiler, Woodstock, IL (US)

(73) Assignee: Weller Engineering, Inc., Elgin, IL (US)

( * ) Notice: Subject to any disclaimer, the term of this patent is extended or adjusted under 35 U.S.C. 154(b) by 209 days.

(21) Appl. No.: 10/409,962

(22) Filed: Apr. 9, 2003

(65) Prior Publication Data

US 2004/0200855 A1 Oct. 14, 2004

(51) Int. Cl.[7] ..... B67D 5/00

(52) U.S. Cl. ..... 222/83

(58) Field of Search ..... 222/83, 91

(56) References Cited

U.S. PATENT DOCUMENTS

| | | | | | |
|---|---|---|---|---|---|
| 4,583,665 | A | * | 4/1986 | Barriac | 222/83 |
| 4,760,941 | A | * | 8/1988 | Salmon et al. | 222/83 |
| 5,427,275 | A | * | 6/1995 | Hansen | 222/83 |
| 5,462,200 | A | * | 10/1995 | Weiler | 222/83 |

* cited by examiner

*Primary Examiner*—Philippe Derakshani
(74) *Attorney, Agent, or Firm*—Olson & Hierl, Ltd.

(57) ABSTRACT

A cap for a hermetically sealed container includes an interior spike and a unitary security ring which is severed from the cap when an attempt is made to remove the cap from the container. The cap is rotatable in one direction to pierce through and puncture the neck of the container and allow access to the container contents. The security ring is severed from the cap when an attempt is made either to remove the cap from the container or to pierce the neck of the container with the interior spike.

10 Claims, 3 Drawing Sheets

CAP WITH UNITARY SECURITY RING

FIELD OF THE INVENTION

This invention relates to hermetically sealed dispensing containers and, more particularly, to a dispensing cap therefor having a unitary security ring associated therewith.

BACKGROUND OF THE INVENTION

U.S. Pat. No. 6,247,616 B1 to Weiler et al. discloses a container which is formed of thermoplastic material, filled with the desired contents, and then sealed all in one continuous operation by a blow/fill/seal technique. The container disclosed therein is sealed by a pierceable membrane which is unitary with an opening defined by the throat of the container and is provided with a piercing external cap.

The system and container described above is particularly desirable where an aseptic contents is to be sealed within a container and thereafter maintained as such. The external cap is secured over the top of the throat and incorporates a spike adapted to pierce the container and allow access to the container contents. The absence of a visual indicator, however, does not allow a user to determine whether the container has been the subject of tampering prior to use.

It would thus be desirable to provide a container including a cap adapted to provide a security and tamper indicator.

SUMMARY OF THE INVENTION

The present invention is directed to a cap adapted for use on a hermetically sealed container having a threaded neck that defines an opening occluded by a pierceable membrane. The cap includes an interior spike and a unitary security ring that is severed from the cap in two ways. Frangible tabs connect the security ring to the cap. The security ring is severed from the cap (1) when an attempt is made to remove the cap from the container or (2) when the cap is rotated to pierce the membrane and gain access to container contents.

In the preferred embodiment, the cap and container neck portion include cooperating threaded surfaces which allow the cap to be threaded over the neck portion in one direction to secure the cap and the security ring over the neck. Further threading of the cap to pierce membrane breaks the frangible tabs. Cooperating toothed surfaces on the ring and the neck cause the ring to engage and abut against the neck when the cap is rotated in the opposite direction to remove the cap from the container; frangible tabs that connect the ring and the cap are then broken before the cap can be unthreaded from the container.

Other advantages and features of the present invention will be more readily apparent from the following detailed description of the preferred embodiment of the invention, the accompanying drawings and the appended claims.

BRIEF DESCRIPTION OF THE DRAWINGS

In the accompanying drawings forming part of the specification and in which like numerals are employed to designate like parts throughout the same.

DESCRIPTION OF THE PREFERRED EMBODIMENT

Figure 2:
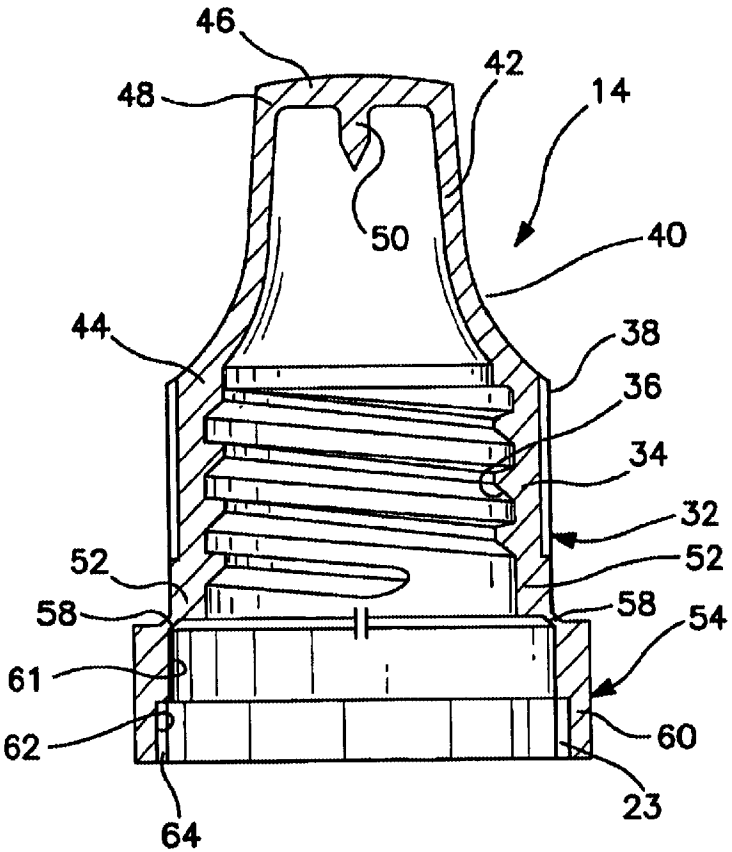
FIG. 2 is an enlarged, vertical cross-sectional view of the cap of the present invention.

The invention disclosed herein is, of course, susceptible of embodiment in many different forms. Shown in the drawings and described hereinbelow in detail is a preferred embodiment of the invention. It is to be understood, however, that the present disclosure is an exemplication of the principles of the invention and does not limit the invention to the illustrated embodiment.

For ease of description, a container equipped with the cap embodying the present invention is described hereinbelow in its usual assembled vertical position as shown in the accompanying drawings and terms such as upper, lower, horizontal, etc., will be used herein with reference to this usual position. However, it is understood that the container and cap may be manufactured, stored, transported, sold, or used in orientations other than that described and shown herein.

Figure 1:
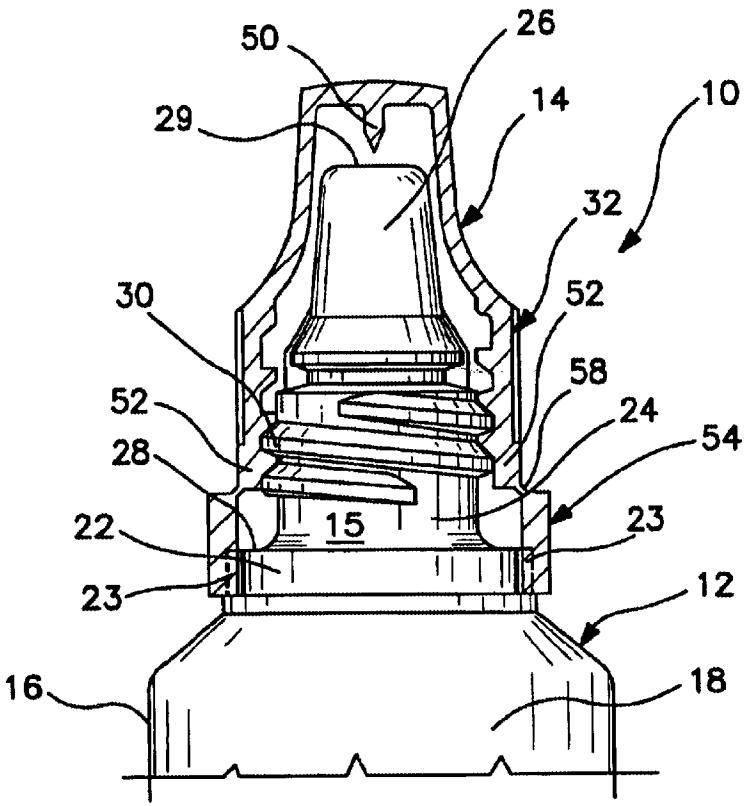
FIG. 1 is an enlarged, part-fragmentary, part-vertical cross-sectional view of the cap of the present invention secured over the neck and nozzle of a hermetically sealed container.

Referring now to FIGS. 1 and 2, a dispenser 10 embodying this invention comprises a hermetically sealed container 12 and a cap 14 threaded onto neck 15. Container 12 is of unitary construction and includes a hollow body portion 16 whose walls are relatively thin and define a liquid-holding cavity 18. Body portion 16 terminates in neck 15 provided with external threads 30. The walls of body portion 16 are relatively thin so that body portion 16 can be manually squeezed, i.e., compressed or distorted to dispense a liquid fill therefrom, as desired.

Container 12 can be molded using a thermoplastic polymer. Presently preferred polymers are low density polyethylene (LDPE), high density polyethylene (HDPE), polypropylene (PP), and the like. The thickness of body portion 16 can vary from one location to another, but is preferably formed as thin as practical, consistent with structural strength requirements.

Container 12 can be made by a parison molding procedure wherein body portion 16 is formed first, then filled with a desired liquid fill, and thereafter sealed while providing a pierceable membrane. The blow, fill and sealing operations are carried out automatically under sterile conditions using procedures known to the art as disclosed in, for example, U.S. Pat. No. 4,178,976 to Weiler et al.

The cap 14 of the present invention can be fabricated with injection molding apparatus and other devices, the details of which, although not illustrated or described, will be apparent to those having skill in the art and an understanding of the necessary functions of such apparatus and devices. The detailed descriptions of such apparatus and devices are not necessary to an understanding of the invention, and are thus not herein presented.

Collar 22 is provided with protuberances around the periphery thereof such as teeth 23, is unitary with the body portion 16, and forms the base of threaded neck portion 24 which, in the embodiment shown, terminates into a unitary tapered nozzle 26. The diameter of the neck portion 24 is less than the diameter of the collar 22 so as to define a radial top shoulder 28 between the collar 22 and the threaded neck portion 24. External threads 30 are formed and extend circumferentially outwardly about an outside wall region of the neck portion 24. Threads 30 can be left-handed or right-handed, as desired. Nozzle 26 is sealed and occluded at the top thereof by a radially extending pierceable membrane 29.

As shown in FIG. 2, cap 14 comprises a skirt 32 defined by a generally cylindrical peripheral circumferential wall 34 that terminates in base 52 and a security ring 54 depending from base 52 of skirt 32. Cap body portion or wall 34 is provided with internal threads 36 threadingly engageable with the neck threads 30 in the manner depicted in FIGS. 1 and 5 and for the purposes described below in more detail. In the illustrated embodiment, the exterior surface of the wall 34 is generally cylindrical and optionally includes a plurality of vertically aligned serrations or grooves 38 which facilitate gripping of the cap 14. Other configurations of gripping assists are suitable as well. Security ring 54 is secured to base 52 by frangible tabs 58 and is described in detail hereinbelow.

Cap 14 additionally includes a unitary dome shaped top 40 comprising a frustoconical wall 42 which projects unitarily upwardly and circumferentially from a threaded portion 44 of wall 34 defining the skirt 32. A spike 50 extends downwardly from the interior face of the cross wall 46 toward the nozzle 26.

Figure 4:
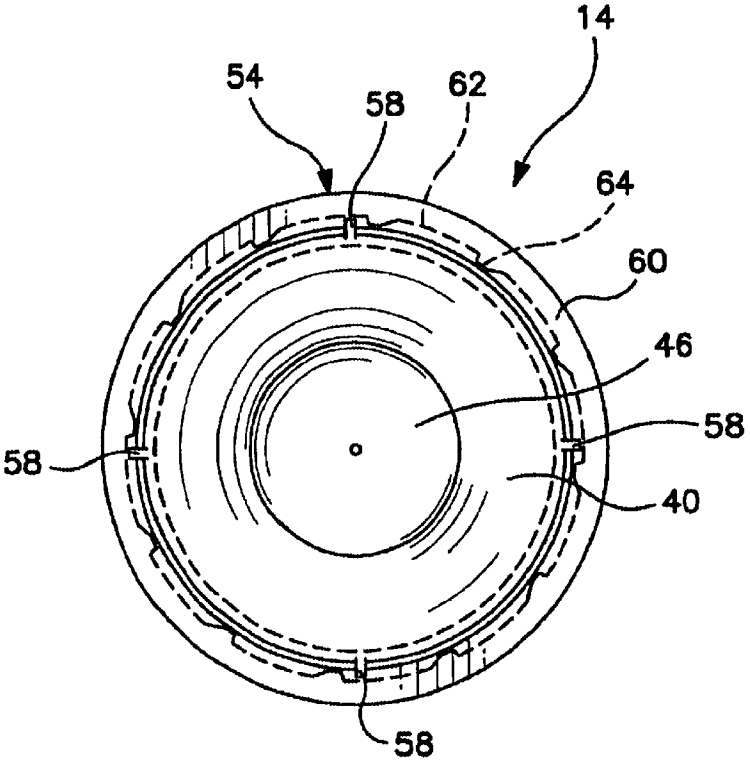
FIG. 4 is an enlarged top plan view of the cap of the present invention.
Figure 3:
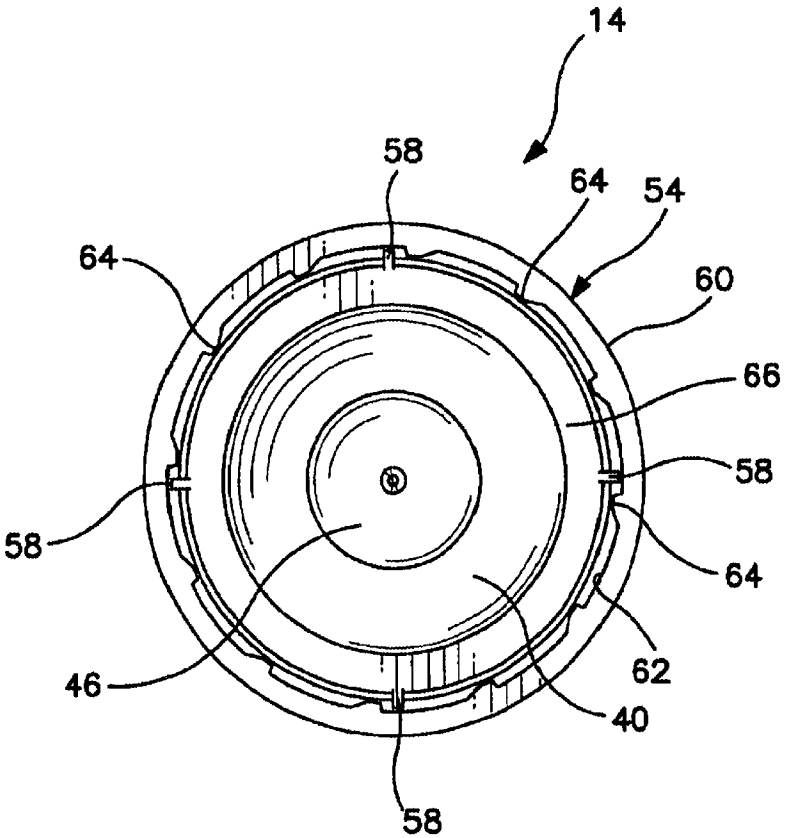
FIG. 3 is an enlarged bottom plan view of the cap of the present invention.

Referring to FIGS. 2–4, security ring 54 depends from cap 14 and extends downwardly and outwardly from base 52 of skirt 32. The inside diameter of the security ring is greater than the outside diameter of the base 52 of the cap. A plurality of spaced frangible tabs such as tabs 58 are unitary with the skirt 32 and the ring 54, and are situated about the circumference of the security ring 54 to removably connect ring 54 with cap 14. Ring 54 defines a cylindrical, circumferentially extending vertical wall 60 which includes an interior circumferential vertical surface 62. A plurality of unidirectional counterteeth 64 extend radially inwardly from the surface 62 and are in a spaced-apart relationship to one another about the circumference of the wall 60. Teeth 64 are adapted to engage with and abut against teeth 23 that extend radially outwardly from the exterior of the collar 22.

Ring 54 surrounds collar 22 as shown in FIG. 1. Tabs 58 extend between the outer peripheral circumferential edge of the base 52, defining the lower portion of skirt 32, and the inner peripheral circumferential edge of the wall 60 of the security ring 54. Tabs 58 are severed under two conditions: when cap 14 is rotated to urge spike 50 against top of nozzle 26 (FIG. 5), or when an attempt is made to remove cap 14 from threaded engagement with neck 24.

Figure 5:
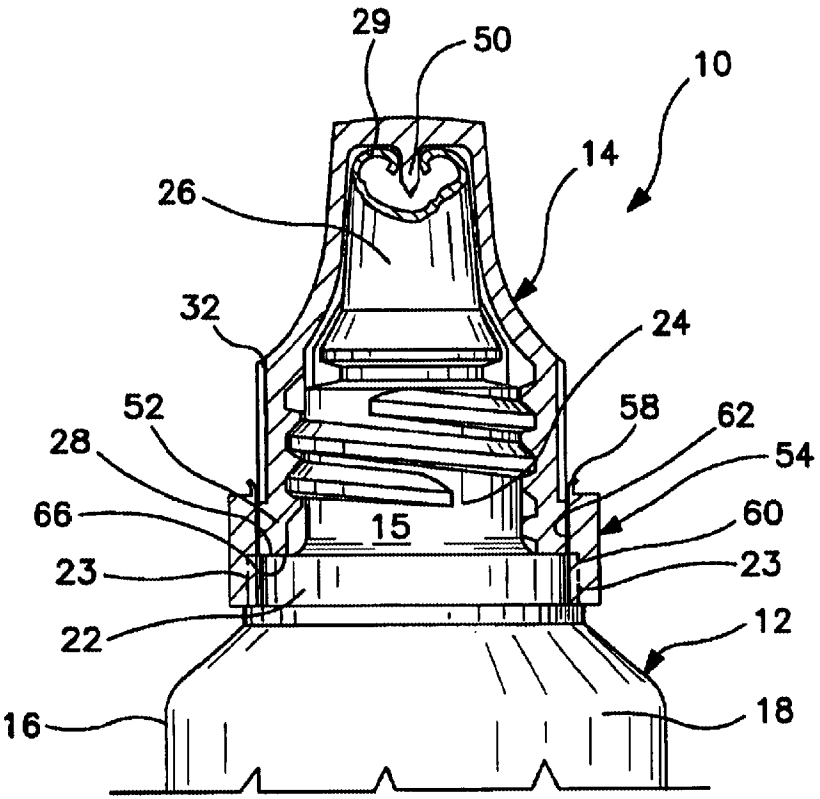
FIG. 5 is an enlarged, part-fragmentary, part-vertical cross-sectional view of the cap in its fully threaded piercing position over the nozzle of the container.

As cap 14 is initially threaded onto neck portion 24, counterteeth 64 on security ring 54 slide over the teeth 23 on collar 22 of container 10. Continued rotation of the cap 14 causes severance of the frangible tabs 58 connecting the ring 54 to the cap 14 as spike 50 pierces nozzle 26 and nozzle membrane 29. When cap 14 is fully threaded over the neck portion 24 and the spike 50 has pierced the membrane 29 as shown in FIG. 5, face 66 of base 52 abuts collar 22 and base 52 is received within security ring 54.

Cap 14 has a length generally about equal to the length of the container neck and nozzle portions 24 and 26 respectively. In its fully threaded relationship over the neck 24 and nozzle 26, the base 52 of skirt 32 is disposed between the severed ring 54 and the outer surface of the neck portion 24. The outer face 66 of base 52 of skirt 32 is abutted against the shoulder 28 of collar 22.

Once cap 14 has been threaded onto neck 24 so that security ring 54 envelops collar 22, and teeth 23 of collar 22 are juxtaposed relative to counterteeth 64 that extend inwardly from wall 60, any attempt to rotate cap 14 in the opposite direction causes counterteeth 64 to engage teeth 23 and thus prevent further rotation without breaking tabs 58. Broken tabs 58 provide a reliable indication that an attempt to remove cap 14 has been made.

The present invention thus provides a cap with a unitary ring which secures the cap to the container and assures the sterility of the pierceable membrane and container contents at all times prior to use of the container while also contemporaneously providing a visual indicator of tampering when the frangible tabs 58 have been severed.

I claim:

1. A cap for a hermetically sealed container having a threaded neck defining an opening occluded by a pierceable membrane, the cap including a base and an interior spike, a security ring unitary with the cap and depending therefrom for securing the cap over the neck, the cap being threadable onto the neck and the security ring being rotatable about the neck when the cap and the ring are rotated together in one direction to sever the cap from the ring before the spike pierces the membrane and the security ring engaging the neck to sever the cap from the ring when the cap is rotated in the direction opposite to said one direction.

2. The cap of claim 1 wherein the neck and cap include cooperating threaded surfaces that allow the cap to be threaded over the neck by rotation in said one direction to secure the cap on the neck without the spike piercing the membrane.

3. The cap of claim 1 wherein the ring and the neck include cooperating toothed surfaces allowing the ring to rotate about the neck in one direction but engaging and locking the ring against the neck when the cap is rotated in opposite direction.

4. The cap of claim 1 further including frangible tabs extending between the ring and the cap.

5. The cap of claim 1 wherein the ring has an inside diameter greater than the outside diameter of the base of the cap.

6. A hermetically sealed container comprising:

a hollow body terminating in a threaded neck defining a sealed opening at one end occluded by a pierceable membrane and a toothed collar at the other end;

a cap seated over the neck and including an interior spike positioned over the pierceable membrane; and a toothed security ring connected to the cap by unitary frangible tabs and adapted to engage against the toothed collar in response to the rotation of the cap in one direction, the cap being rotatable in an opposite direction to pierce the membrane with the spike and sever the ring from the cap by breaking the frangible tabs.

7. The container of claim 6 wherein the frangible web comprises a plurality of spaced frangible tabs that extend between the ring and the cap.

8. The container of claim 6 wherein the collar defines a shoulder and the cap includes a lower face adapted to abut against the shoulder.

9. A cap for a hermetically sealed container provided with a threaded neck that defines a collar and an opening occluded by a pierceable membrane, the cap comprising:

a body portion adapted to threadably receive the neck of the container and terminating in a base;

a security ring connected to the body portion by frangible tabs, having an inside diameter greater than that of the base, and adapted to engage the collar for severing the frangible web and separating the body from the ring; and an internal spike in the body portion adapted to puncture the pierceable membrane in response to the lowering of the body over the neck following separation of the body from the ring;

wherein the security ring is rotatable about the collar only in the direction that urges the spike against the pierceable membrane.

10. The cap of claim 9 wherein the security ring is provided with inner peripheral teeth, wherein the collar is provided with external peripheral protuberances, and wherein the inner peripheral teeth engage the protuberances when the cap is rotated in a direction to remove the cap from the threaded neck.

* * * * *